United States Patent [19]

Grande

[11] Patent Number: 4,480,793

[45] Date of Patent: Nov. 6, 1984

[54] LIQUID DISTRIBUTION DEVICE

[76] Inventor: Gary R. Grande, 5395 S. Ravendale Cir., Las Vegas, Nev. 89120

[21] Appl. No.: 279,840

[22] Filed: Jul. 2, 1981

[51] Int. Cl.[3] ..... B05B 1/14

[52] U.S. Cl. ..... 239/567; 239/102

[58] Field of Search ..... 239/101, 200, 567, 590, 239/559, 102

[56] References Cited

U.S. PATENT DOCUMENTS

| | | | |
|---|---|---|---|
| 1,629,490 | 5/1927 | Erwin et al. | 239/567 X |
| 2,311,266 | 2/1943 | Svet | 239/567 X |
| 2,746,792 | 5/1956 | Hough | 239/567 X |
| 2,884,205 | 4/1959 | Van Buren | 239/567 X |
| 3,001,533 | 9/1961 | Holdren | 239/567 |
| 3,034,733 | 5/1962 | Brooks et al. | 239/567 X |
| 3,079,937 | 3/1963 | Tooper et al. | 239/567 X |
| 3,563,462 | 2/1971 | Bauer | 239/102 |
| 3,684,176 | 8/1972 | Hruby | 239/590 |
| 3,747,858 | 7/1973 | Krynicki | 239/101 X |
| 4,052,002 | 10/1977 | Stouffer et al. | 239/102 |
| 4,055,302 | 10/1977 | Hruby | 239/102 |
| 4,087,049 | 5/1978 | Traina | 239/567 X |
| 4,231,519 | 11/1980 | Bauer | 239/102 |
| 4,394,965 | 7/1983 | Backe et al. | 239/102 |

*Primary Examiner*—John J. Love

*Attorney, Agent, or Firm*—Seiler, Quirk & Tratos

[57] ABSTRACT

A liquid distribution device having preferred utility as a lawn sprinkler head consists of a hollow chamber having continuously curved interior walls and having a series of exit ports disposed therein. The interior chamber walls are structured to create a rapidly rotating turbulent mass of fluid in the chamber, producing a rapidly directionally unstable flow of discrete drops from each exit port. The chamber is preferably ellipsoidal in shape, and has a total exit-port cross-sectional area greater than that of the fluid inlet to the chamber.

20 Claims, 20 Drawing Figures

LIQUID DISTRIBUTION DEVICE

BACKGROUND OF THE INVENTION

This invention relates generally to irrigation systems, and specifically to a device for distributing liquid uniformly over a desired area. More particularly, the invention provides a lawn sprinkler nozzle having no moving parts which distributes a plurality of bursts of discrete drops which oscillate in both horizontal and vertical planes.

The problems associated with the development of a low-cost, effective sprinkler or spray head, particularly for lawn or turf irrigation, have proven to be a technically fascinating but frustrating chore. Several different varieties are commercially available, and the literature is replete with many dozens of designs. In the past, systems have used such designs as a plurality of nozzles delivering a fixed irrigation pattern, mechanically rotated or oscillated nozzles delivering a generally narrow stream of water in an angular sweep, and various nozzle designs to provide generally dispersed jets of water. Most of these systems suffer from one or more shortcomings; for example, spray heads often produce a mist or fog rather than discrete droplets, thereby causing high evaporation losses and very poor distribution patterns particularly if a breeze exists, or, because of the fixed angle of stream exit, water is distributed non-uniformly over the area desired to be covered. Most small spray heads used in permanent lawn installations have narrow passageways which plug easily. Mechanically rotated units are cumbersome and expensive. Units having moving parts, such as are shown in Krynicki, U.S. Pat. No. 3,747,858, are subject to jamming or clogging from corrosion, traffic, dirt, or grass clippings.

Descriptions of several spray heads having pulsating or oscillating discharges formed without moving parts exist in the prior art. A nozzle having a flow-splitting "wedge" in a jet stream producing a very rapid oscillation in one plane is shown in Stauffer, U.S. Pat. No. 4,151,955. Frempter, U.S. Pat. No. 3,301,493 discloses a sprinkler head having an elongate cylindrical chamber and a single horizontal slotted discharge which produces a "fluttering" discharge apparently produced by interaction of water and air at the top of the cylindrical chamber. Hruby, U.S. Pat. No. 3,684,176 has a large chamber with an oblique inlet and a single long outlet duct at the top of the chamber to produce a pulsating spray. An oscillating spray is also produced in Hruby, U.S. Pat. No. 4,055,302 in a nozzle having a tortuous fluid path terminating in a single flared conical nozzle.

Non-oscillating sprinkler heads having a plurality of discharge apertures communicating with an interior chamber of vertically decreasing cross-section are shown in Svet, U.S. Pat. No. 2,311,266, and Garabedian, U.S. Pat. No. 2,493,719. The Svet patent shows a head having a plurality of bores in the hemi-ellipsoidal chamber wall. A large fastener extending vertically through the chamber, along with the ;arge discontinuity in the chamber wall at the bottom of the hemi-ellipsoid, and the large inlet channels at the sides of the chamber would all preclude this device from establishing a fluid-flow pattern necessary to produce oscillation. The Garabedian patent has an inverted conical head having a cap thereover; the cap is rotatable to permit holes in the cap to register with holes in the head to provide flow control. The Garabedian head, having a large inlet and ledge formed by the base of the conical cap and straight chamber side walls, again will not produce an oscillating spray.

It has been discovered in accord with the present invention that particular interior chamber geometries coupled with a critical ratio of chamber outlet to chamber inlet areas provides directionally unstable discharge of a series of discontinuous streams of discrete drops of varying velocities. Each stream of drops thus oscillates in both a vertical and horizontal plane. Stop-action photographs of the oscillating streams show that while the basic pattern of oscillation is random, control of vertical oscillatory frequency can be superimposed by proper alignment of the inlet relative to the output orifice array. Oscillation from each discharge orifice occurs through vertical angles of as much as 45°-50°, and horizontal angles of up to about 20°, resulting in a very uniform distribution pattern. Sprinkler heads made in accord with the invention produce almost no misting even at high line pressures, thus reducing evaporation loss and imparting wind resistance to the liquid discharge of drops.

The oscillatory potential of the liquid discharge is a function of the design of the nozzle chamber. The chamber has a plurality of sharp-edged discharge ports in the chamber wall which extend to various extents (depending on whether full-, half-, quarter-head, or some other watering pattern is desired) around the periphery of the head. The chamber is entirely hollow and unobstructed, and has an upper wall portion which is curvilinear in both horizontal and vertical cross-sections. The upper chamber portion is preferably symmetrical about its vertical axis, having a circular or elliptic horizontal cross-section continuously decreasing in radius toward its uppermost portion (e.g., ellipsoidal, elliptic paraboloidal, or spherical). The lower portion of the chamber is curvilinear, preferably circular in horizontal cross-section, and may be straight or curvilinear in vertical cross-section. The width of the interior of the lower portion of the chamber either remains constant or decreases downwardly. An inlet port is located at the bottom of the chamber; for typical residential scale turf irrigation the area of the inlet port is importantly equal to or smaller than the total area of the outlet ports. The head functions as described herein because the jet of water exiting the inlet port interacts with the surrounding fluid and the chamber geometry to induce formation of a rapidly rotating, turbulent mass of water which travels along the chamber wall towards the discharge orifices. The aforesaid jet interaction with the ambient fluid and chamber geometry creates vortex-like cells of varying velocities within the main mass of rotating fluid. The differential velocities of the cells thus created cause the direction of the jet relative to the chamber walls to change periodically, thereby producing changes in direction of the turbulent rotating mass of fluid therein. Over a given time period the fluid mass thus approaches the discharge orifices from many different directions, thereby causing oscillations of the liquid discharge.

Accordingly, it is an object of the invention to provide liquid distribution apparatus which distributes discrete drops of liquid in a generally uniform distribution pattern. It is a further object of the invention to provide a sprinkler head which produces discontinuous streams of discrete drops which oscillate in multiple planes. It is yet a further object of the invention to provide a lawn sprinkler head having no moving parts, which is easily and inexpensively manufactured, and which provides relatively even ground coverage without production of aerosols. These and other objects of the invention will be evident from the following detailed description of preferred embodiments of the invention.

SUMMARY OF THE INVENTION

Liquid distribution apparatus comprises an unobstructed hollow chamber defined by one or more walls, the interior chamber walls being substantially continuously curved, and an upper portion of the chamber walls having curvilinear horizontal and vertical cross-sections. The upper portion of the chamber wall has a plurality of discharge ports, and a lower portion of a chamber wall has inlet means; the total effective cross-sectional area of the discharge ports is equal to or greater than, and preferably at least 1.4 times greater than, the cross-sectional area of the inlet means.

BRIEF DESCRIPTION OF THE DRAWINGS

The invention is best understood with reference to the drawings, in which.

DETAILED DESCRIPTION OF A PREFERRED EMBODIMENT

Figure 1:
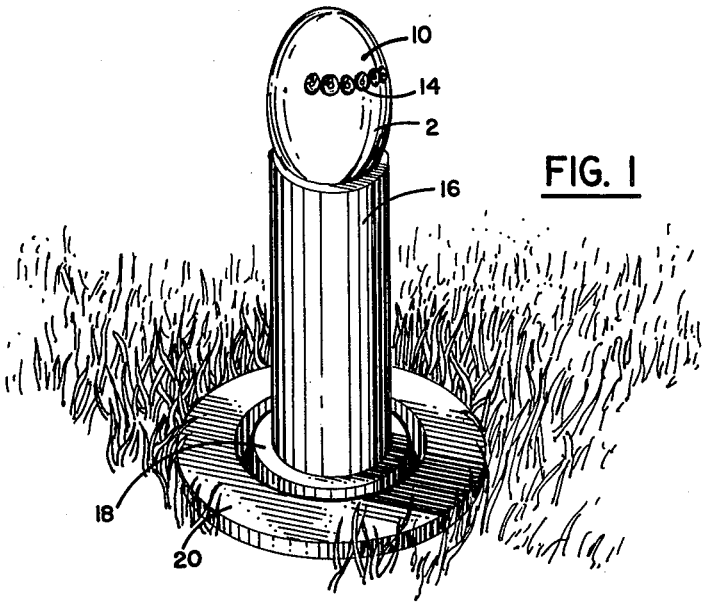
FIG. 1 is a perspective view of a pop-up lawn sprinkler head fabricated according to the invention.

Referring first to FIG. 1, a pop-up lawn sprinkler half head 2 fabrication in accord with the invention is shown in perspective in the elevated, or operating, position. The terms "full head", "half head", and "quarter head" as used herein mean spray heads providing circular, semi-circular, and quarter-circular distribution patterns, respectively; in each case, the head is located at the center of the circle. Other distribution patterns may be realized by differing placements and sizes of the outlet orifices on the chamber wall surface. The head consists of a egg-shaped or ellipsoidal discharge portion 10 having a series of horizontally aligned discharge ports 14 mounted on a riser tube 16. The long axis of the ellipsoid is oriented vertically. The shaft is mounted on a base 18 having a ledge 19 which abuts the lower portion of ring 20 when the head is raised into operating position. Guides (not shown) in the ledge 19 prevent rotation of the shaft in the ring. When the water pressure to the head is turned off, the shaft drops by gravity or spring pressure (spring not shown) to a resting position in which the uppermost tip of discharge head 10 is below the upper surface of ring 20. The particular method of mounting the distribution apparatus of the invention forms no part of the invention, and it will be readily apparent to those skilled in the art that any conventional support for this apparatus may be used.

Figure 2:
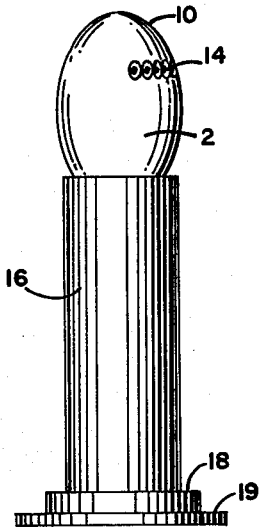
FIG. 2 is a side elevational view thereof.
Figure 3:
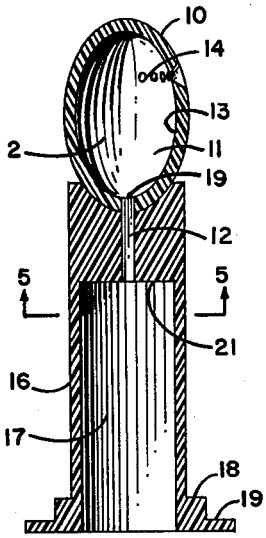
FIG. 3 is a side section thereof.

The half head shown in FIG. 1 is shown in side elevational view in FIG. 2 and in side section in FIG. 3. The discharge head 10 of spray apparatus 2 has an interior discharge chamber 11 formed by chamber wall 13. The chamber is ellipsoidal in shape, with the longitudinal axis being vertical. The chamber wall has an aperture 9 at the bottom portion thereof which forms the discharge end of inlet duct 12. The inlet duct communicates with a chamber 17 at the lower portion of the shaft; this chamber is simply a portion of the water feed line and its size and shape are not critical, although its cross-sectional area is desirably significantly greater than that of the inlet duct such that unnecessary pressure drops do not result.

Figure 4:
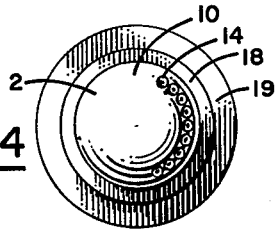
FIG. 4 is a top view of a half-head.
Figure 7:
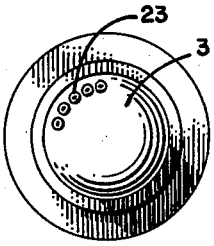
FIG. 7 is a top view of a quarter-head.
Figure 8:
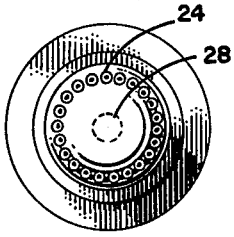
FIG. 8 is a top view of a full head.

A top view of the half head is shown in FIG. 4. The discharge ports 14 are of uniform size and are located in a horizontal plane around an upper portion of the spray head. The ports extend around about 165° of the periphery; extension to a full 180° to obtain semicircular coverage is not necessary because of the oscillation of the droplet streams in the horizontal plane. A top view of a similarly mounted quarter head 3 is shown in FIG. 7, discharge ports 23 extend slightly less than 90° around the periphery of the head. A full head 4 having ports 24 extending completely around the periphery is shown in FIG. 8; the circular inlet 28 is shown in phantom.

Figure 5:
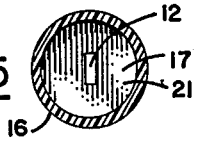
FIG. 5 is a horizontal section of the half-head taken along section lines 5—5 of FIG. 3 showing the inlet duct.
Figure 6:
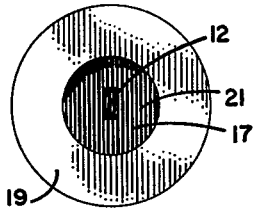
FIG. 6 is a bottom view of the head of FIG. 3.

A section view of the lower portion of shaft 16 showing the upper wall 21 of chamber 17 and the end of inlet duct 12 is shown in FIG. 5. The inlet duct is also shown in bottom view of the device of FIG. 6. The half-head inlet duct is of uniform rectangular cross-section, with a long side of the rectangle aligned perpendicular to the center of the array of discharge ports (see FIGS. 4—6). Other alignments may be used to create different drop distribution patterns.

Figure 9:
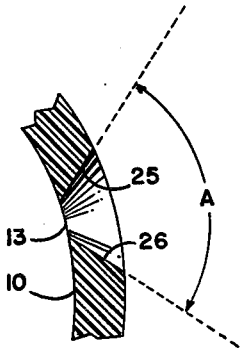
FIG. 9 is a partial section view of an upper portion of a head showing a discharge port.

FIG. 9 shows a partial section of a portion of the discharge chamber and one of the discharge ports. The discharge port is a countersunk aperture having inwardly sloped walls 25 and 26 forming an angle "A" of 90°. This angle may be greater or smaller but to realize maximum oscillation must equal the potential angle of escape of the fluid eject from the chamber. Potential angle of escape is a function of wall curvature, orifice diameter, inlet placement and outlet inlet ratio. These walls form sharp edges with the curved interior wall 13, which allows a greater angle of escape of the discharge of water drops. While a sharp-edged aperture is preferred, wide cylindrical countersinks with very short narrow ducts have been used with success, though angles of potential oscillation are reduced. Countersinking may be achieved of course in any manner, e.g., by molding, the result of having an aperture through the chamber wall having an outwardly increasing size being more important than the method of formation.

Figure 18:
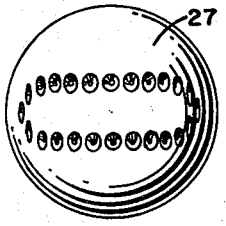
FIG. 18 is a top view of an ellipsoidal head which produces a "strip" or elongated rectangular water distribution pattern.

For typical residential scale lawn watering, circular discharge ports are preferably from about 0.05" to about 0.08" in diameter at the inside wall, but need not be uniform in size. Multiple non-circular ports may also be used provided their individual areas are approximately the same as circular one, i.e., from about 0.002 sq.in. to about 0.005 sq.in. Larger ports tend to produce drops which are too large, promoting soil compaction, and smaller orifices tend to produce undesirably small droplets or mists. While a single horizontal row of discharge ports is shown in the half, quarter, and full heads of FIGS. 4, 7, and 8, several rows may be used, and different sizes ports may be used on different rows or on the same row. Additionally, the ports need not be arranged in rows, as can be seen in FIG. 18, which shows a top view of an ellipsoidal full head 27 which produces a generally rectangular elongated watering pattern. The particular number, size, orientation, and shape of discharge ports will depend upon the type of distribution pattern desired. While multiple ports, preferably at least 3, are preferred, a single slit orifice (in a one-half or one-quarter head for example) can be used but at typical water line pressures for turf irrigation would have to be quite narrow to preserve chamber pressure and consequently the radius of water distribution. This is undesirable as very narrow orifices of any shape will tend to produce aerosols even at normal operating pressures. Multiple ports also result in a mechanically stronger nozzle assembly. The ports may be of a variety of shapes, such as a series of horizontal or vertical slits, square, triangular, oval, etc. While the area ratio of the ports to the inlet is very important, to produce maximum oscillation of the discharge, the shape does not appear to be critical.

Figure 10:
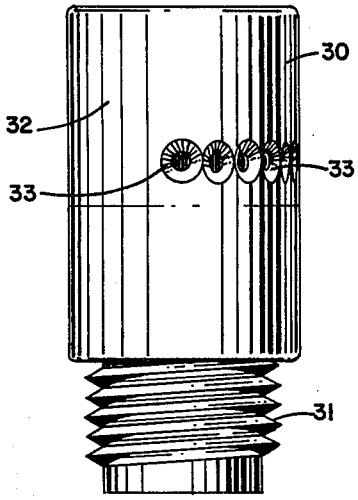
FIG. 10 is an external side view of another version of the head.
Figure 11:
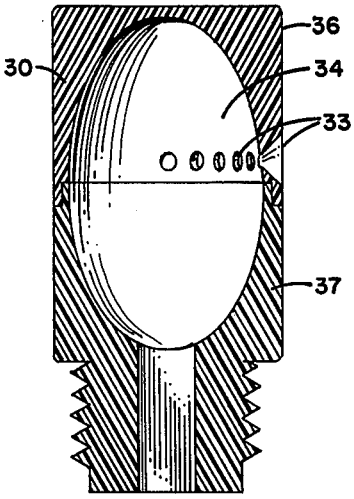
FIG. 11 is a side section view of the head of FIG. 10.

In addition to the type and placement of discharge ports, many variations can be made within the scope of the invention to obtain specific desired results. In general, exterior configuration of the heads is not critical to their performance. Exterior configuration may depend on such variables as cost, ease of manufacture, and durability. A particularly preferred and easily manufactured embodiment is shown in FIGS. 10 and 11; in this mode, a screw-in head 30 having male threads 31 for connection to conventional pipe fittings or to the upper portion of a tubular sprinkler pop-up riser has a cylindrical exterior surface 32 which is attractive, easily molded from plastic, and sturdy. The head contains discharge ports 33 of the type previously discussed. The head contains an ellipsoidal discharge chamber 34 as shown in FIG. 11. The device is molded from an upper portion 36 and lower portion 37, which fit together as shown and can be either glued or sonic welded along the seam to provide a unitary structure. The inlet is rectangular with a short edge of the rectangular facing the center of the array; this results in a somewhat rectangular distribution pattern.

Figure 12:
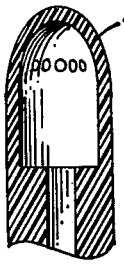
FIG. 12 is a side section view of a half-head having an ellipsoidal upper chamber portion and a cylindrical lower chamber portion.
Figure 13:
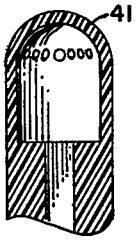
FIG. 13 is a side section view of a half-head having a hemispherical upper chamber portion and a cylindrical lower chamber portion.
Figure 14:
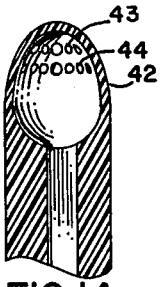
FIG. 14 is a side section view of a half-head having a ellipsoidal upper chamber portion and a hemispherical lower chamber portion.
Figure 15:
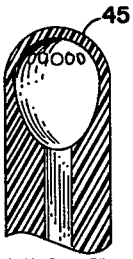
FIG. 15 is a side section view of a half-head having a hemispherical upper chamber portion and a ellipsoidal lower chamber portion.
Figure 16:
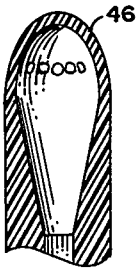
FIG. 16 is a side section view of a half-head having a ellipsoidal upper chamber portion and a truncated conical lower chamber portion.
Figure 17:
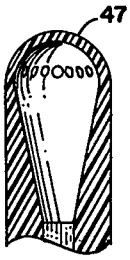
FIG. 17 is a side section view of a half-head having a hemispherical upper chamber portion and a truncated conical lower chamber portion.

The particular shape of the interior chamber is very important, but may be varied considerably within the parameters believed important. The chamber must be a substantially unobstructed hollow chamber having a horizontal cross-section which is a continuous curve. The chamber is preferably symmetrical about a vertical plane extending through its vertical axis, and is more preferably symmetrical about any plane in which its vertical axis is contained. The horizontal cross-section is preferably circular or elliptic with an upwardly decreasing radius at its upper portion toward its top. An upper portion of the chamber, which generally carries the discharge ports, has walls which are curvilinear in both horizontal and vertical cross-sections; the lower portion of the chamber must be curvilinear in horizontal cross-section but may be straight in vertical cross-section. For effective vertical oscillation, the chamber length must exceed its width. Examples of configurations of heads within the scope of the invention are shown in the cross-sectional views of FIGS. 12–17. FIG. 12 shows a head 40 having a paraboloidal upper portion and a cylindrical lower portion. FIG. 13 shows head 41 having a hemispherical upper section and a cylindrical lower portion. FIG. 14 shows an ellipsoidal section mounted over a hemispherical lower portion on head 42; this head also has two parallel rows of discharge ports 43 and 44 in the upper chamber portion. FIG. 15 shows a head 45 comprising a hemispherical upper portion and an ellipsoidal lower portion. FIG. 16 shows a half head 46 having an ellipsoidal upper portion and a frusto-conical lower portion, and FIG. 17 depicts a head 47 having a hemispherical upper portion and a conical lower portion. Each of FIGS. 12–17 shows a half head with a rectangular inlet, with the long side of the rectangle shown aligned approximately parallel to the row of discharge ports.

Both the size and shape of the inlet to the operating chamber are important, although considerable variation in shape may exist. Inlets having circular and rectangular cross-sections have been successfully used, and oval, semi-circular, and other geometric cross-sections, such as annular rings, can be used. Circular inlets are preferred for three-quarter and full heads, whereas rectangular or oval inlets are preferred for half or quarter heads. The inlet is preferably centrally located at a bottom portion of the discharge chamber, although the inlet can be moved off center or canted to create variations in oscillatory frequency (and hence different precipitation patterns). The inlet size, and its relationship to the area of the discharge ports is, however, critical. It is absolutely essential that the cross-sectional area of the total of the discharge ports for a full or $\frac{3}{4}$ pattern head be at least equal to or greater than, and preferably at least 1.4 times greater than, the cross-sectional area of the inlet. Half heads and quarter heads need even greater ratios, preferably at least 2:1, to oscillate maximally. If the discharge ports have a cross-sectional area substantially smaller than that of the inlet, the discharge chamber functions simply as a sudden enlargement in the line, and non-oscillating streams of water are produced from the head.

The invention contemplates that the discharge chamber interior is substantially unobstructed and has sidewalls which are substantially continuously curved. By "substantially continuously curved" is meant a wall which has a cross-section having substantially no straight lines; while is it possible to construct an interior wall from a series of very short straight segments, the wall is substantially curvilinear if the water flow around the interior wall follows a relatively smooth, continuous path. By "substantially unobstructed" is meant that the interior is hollow without flow obstructing members extending into the interior; i.e., the interior surface must be continuous, without any substantial ledges, protrusions, or other discontinuities which would obstruct flow.

While the theory of operation of the devices of the invention is not completely understood and forms no part of the invention, an understanding of the principles of operation is helpful to appreciate both its simplicity of ultimate structure and the complexity of the reasons for successful operation. The flow pattern of a preferred ellipsoidal design of the head is illustrated in FIGS. 19 and 20.

Figure 19:
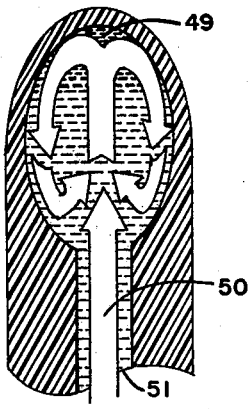
FIG. 19 is a schematic diagram of initial water flow in an ellipsoidal head.
Figure 20:
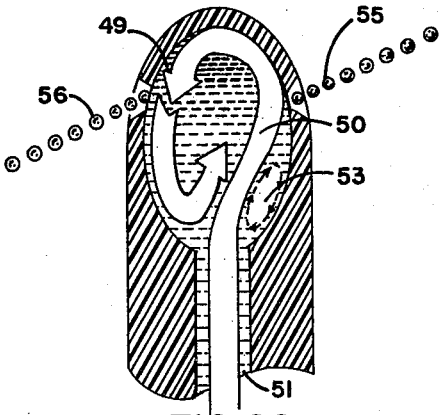
FIG. 20 is another schematic diagram of water flow in an ellipsoidal full head showing exit direction of discharge relative to direction of liquid mass rotation.

As shown in FIGS. 19, the fluid stream 50 entering the inlet 51 of discharge chamber 49 jets upwardly toward the concave upper walls of the chamber, distributing downwardly in an umbrella-like pattern. Because of the interaction of the inlet jet with the surrounding fluid medium and the interior chamber shape, internal cells of varying velocities are formed around the jet, many of which can coexist at any given time. A cell composed of a high velocity rotating mass of fluid shown as cell 53 in FIG. 20, will tend to have a lower internal pressure across its boundaries than that of the lower velocity ambient fluid. The inlet jet 50 will bend toward the wall over the cell with the lowest internal pressure as shown in FIG. 20; the tendency of the jet to bend towards the wall beyond the upper-limit of a low pressure cell is known as the Coanda effect. Because of the continuously curved horizontal cross-section of the "3 dimensional" chamber, the inlet jet cannot seal off the low pressure cell from the remainder of the chamber. Therefore, fluid from other parts of the chamber migrates to the cell, changing local velocities and pressures, causing the cell to shift rapidly from side to side (or to extinguish and be created elsewhere). As the jet "follows" the minor shifts of the low pressure cell, rapid horizontal oscillation of about 18° in the output of each discharge port results. When major movements of a low pressure cell occur, the jet, in response to the large pressure differential across it, will make major movements such as a 180° shift from one wall to the opposite wall. These major changes in jet orientation create reversals in the rotational direction of the fluid mass in the chamber. Such reversals are responsible for the vertical oscillatory component of the output of drops.

The formation of true cohesive streams of liquid output is prohibited by the highly convoluted stream tubes formed in the turbulent fluid within the chamber. Such "tubes" cause each unit of fluid particles to exit the nozzle at different velocities.

The frequency and degree of oscillation of the output is controlled by the position and attitude of the inlet relative to the outlet array, the inlet/outlet area ratio, the chambers internal volume and line pressure feeding the chamber.

If the jet is bent across a low-pressure cell toward the wall on an upward path as shown in FIG. 20, the discharge profile of the drops 55 will be in an upwardly direction. As the water follows the chamber contour past the uppermost portion of the chamber, water flows down the opposite wall, causing a downward ejection profile 56 from the opposite discharge ports. When the jet is bent toward the opposite wall, the fluid mass rotation is reversed, as is the drop ejection profile, as shown in FIG. 20.

While the invention has been described having utility for lawn and agricultural sprinklers, in principle it has utility for other devices such as fire sprinklers, dental irrigation devices, fountain nozzles, shower heads, therapy tub jets, and the like. In addition, various modifications to the invention will be obvious to those skilled in the art, and the invention should not be considered limited to the specific embodiments described herein.

I claim:

1. A turf irrigation device adapted to be connected to a pressurized liquid source comprising a body member having a substantially unobstructed hollow chamber therein having upper and lower portions, said chamber being defined at least in part by one or more walls, a single liquid inlet means in the lower portion of the chamber for passing a jet of water upwardly into said chamber, a plurality of liquid discharge ports in the upper portion of the chamber walls, at least two of said ports being disposed radially from a vertical axis of the chamber such that fluid exits along an axis angularly disposed from said vertical axis, said chamber having an enclosed upper wall at a top portion of the chamber precluding passage of a substantial portion of fluid out from the chamber in a direction parallel to the vertical axis of the chamber, the upper portion of said chamber having substantially curvilinear horizontal and vertical cross-sections, the lower portion of the chamber having a curvilinear horizontal cross-section, said upper and lower portions being connected by smooth walls having substantially no discontinuity, the total cross-sectional area of the discharge ports being at least about 1.4 times greater than the cross-sectional area of the inlet means, whereby a rotating mass of water is created in the chamber, producing rapidly moving discharges of discrete droplets from the discharge ports.

2. The device of claim 1 wherein the upper portion of the chamber is symmetrical about any plane in which its vertical axis is contained.

3. The device of claim 1 in which the upper portion of the chamber has a circular or elliptical horizontal cross-section.

4. The device of claim 1 in which the lower portion of the chamber has a circular horizontal cross-section.

5. The device of claim 1 in which the chamber is ellipsoidal in shape, with the long axis of the ellipsoid oriented vertically.

6. The device of claim 1 in which the upper portion of the chamber is hemispherical.

7. The device of claim 1 in which the upper portion of the chamber is hemi-ellipsoidal.

8. The device of claim 1 in which the lower portion of the chamber has the shape of an ellipsoidal section.

9. The device of claim 1 in which the lower portion of the chamber is frusto-conical.

10. The device of claim 1 in which the lower portion of the chamber is hemispherical.

11. The device of claim 1 in which the ratio of the total area of outlet ports to the cross-sectional area of inlet means is at least about 2.0:1.

12. The device of claim 1 in which the inlet means is an orifice having a circular cross-section.

13. The device of claim 1 in which the inlet means is an orifice having a rectangular cross-section.

14. The device of claim 1 having at least three outlet ports.

15. The device of claim 1 wherein the outlet ports comprise apertures in the chamber wall increasing in size outwardly through the wall.

16. The device of claim 1 wherein the outlet ports comprise round countersunk bores in the chamber wall.

17. The device of claim 1 wherein the body member is a full sprinkler head having outlet ports uniformly spaced around the periphery.

18. The device of claim 1 wherein the body member is a half sprinkler head having outlet ports uniformly spaced about a portion of the periphery, and where the inlet means is an aperture having a rectangular cross-section.

19. The device of claim 18 wherein the inlet means is oriented such that a long edge of the cross-section is perpendicular to the center of the array of outlet ports.

20. A turf sprinkler head comprising a chamber formed by walls having curvilinear surfaces along vertical and horizontal cross-sections, a fluid inlet at a bottom portion of the chamber adapted to direct a fluid jet into a central portion of the chamber, at least three liquid discharge ports in side walls of the chamber adapted to discharge fluid in directions angular to the vertical axis of the chamber, said chamber having an enclosed upper wall at a top portion of the chamber precluding passage of a substantial portion of fluid out from the chamber in a direction parallel to the vertical axis of the chamber, the total cross-sectional area of the discharge ports being at least about 1.4 times greater than the cross-sectional area of the inlet, whereby a rotating mass of liquid is created in the chamber when the inlet in connected to a source of pressurized fluid producing rapidly oscillating discharges of discrete droplets from the discharge ports.

* * * * *